US006745425B1

(12) United States Patent
Tope

(10) Patent No.: US 6,745,425 B1
(45) Date of Patent: Jun. 8, 2004

(54) COPPER PIPE CLEANING TOOL

(75) Inventor: Thomas L. Tope, Polson, MT (US)

(73) Assignee: Gayle Brueggeman, Polson, MT (US)

( * ) Notice: Subject to any disclaimer, the term of this patent is extended or adjusted under 35 U.S.C. 154(b) by 117 days.

(21) Appl. No.: 10/090,412

(22) Filed: Feb. 28, 2002

Related U.S. Application Data

(60) Provisional application No. 60/272,074, filed on Feb. 28, 2001.

(51) Int. Cl.[7] ..... B08B 9/02

(52) U.S. Cl. ..... 15/104.04; 15/104.05; 15/108; 15/160; 15/104.095

(58) Field of Search ..... 15/104.04, 104.05, 15/106, 104.2, 104.195, 104.16, 88, 104.03, 23, 160

(56) References Cited

U.S. PATENT DOCUMENTS

| | | | | |
|---|---|---|---|---|
| 1,838,958 A | * | 12/1931 | Page | 15/160 |
| 1,950,862 A | * | 3/1934 | Page | 15/106 |
| 3,076,988 A | | 2/1963 | Mills | 15/104.04 |
| 4,014,063 A | | 3/1977 | Bunke | 15/104.04 |
| 4,301,568 A | | 11/1981 | Poschlod | 15/104.04 |
| 4,862,549 A | | 9/1989 | Criswell et al. | 15/104.04 |
| 5,493,748 A | | 2/1996 | Santo | 15/104.04 |
| 5,566,416 A | | 10/1996 | Karls | 15/104.04 |
| 5,809,603 A | | 9/1998 | White | 15/104.04 |

* cited by examiner

*Primary Examiner*—Gary K. Graham
(74) *Attorney, Agent, or Firm*—Richard C. Conover

(57) ABSTRACT

The invention includes a holder body having a first tubular portion flaring into a second tubular portion. A wall separates the first tubular portion from the second tubular portion. A hard wire brush is affixed to the inner surface of the first tubular portion, and a hard wire brush is affixed to the inner surface of the second tubular portion. A drive shank is provided having an end for use in a chuck or collet of a drill, and a free end sized to be received either by a socket located in the first tubular bore or a socket provided in the second tubular bore. Further, a brush shank is provided having a hard wire brush attached at one end. The free end of the brush shank sized to be removably received by either the first or second tubular sockets.

2 Claims, 1 Drawing Sheet

COPPER PIPE CLEANING TOOL

This application claims benefit of provisional application No. 60/272,074 filed 28 Feb. 2001.

BACKGROUND OF INVENTION

The present invention relates to a cleaning tool which can be used to simultaneously clean the outside surface and the inside surface of an end of a copper pipe in preparation for soldering.

Pipe cleaning tools are known for cleaning the inside and outside surfaces of a pipe to be joined prior to soldering. See, for example, U.S. Pat. No. 4,862,549 to Criswell, et al., and U.S. Pat. No. 5,493,748 to Santo.

The present invention provides a tool for cleaning the outside and inside surfaces of a pipe of various diameters merely by reversing the tool ends. With the present invention, the tool is inserted in a chuck of a power drill and can be used easily to clean the exterior and interior surfaces of ½" pipes or ¾" pipes easily, simply by reversing the body of the tool.

SUMMERY OF INVENTION

The present invention relates to a two-ended copper pipe cleaning tool which can be used to simultaneously clean the outside surface and the inside surface of an end of a copper pipe in preparation for soldering. One end of the tool is used for cleaning a pipe having a first diameter, and the second end of the tool is used for cleaning a pipe having a larger size diameter. The invention includes a holder body having a first tubular portion flaring into a second tubular portion. A wall separates the first tubular portion from the second tubular portion. A hard wire brush is affixed to the inner surface of the first tubular portion, and a hard wire brush is affixed to the inner surface of the second tubular portion. A drive shank is provided having an end for use in a chuck or collet of a drill, and a free end sized to be received either by a socket located in the first tubular bore or a socket provided in the second tubular bore. Further, a brush shank is provided having a hard wire brush attached at one end. The free end of the brush shank sized to be removably received by either the first or second tubular sockets.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
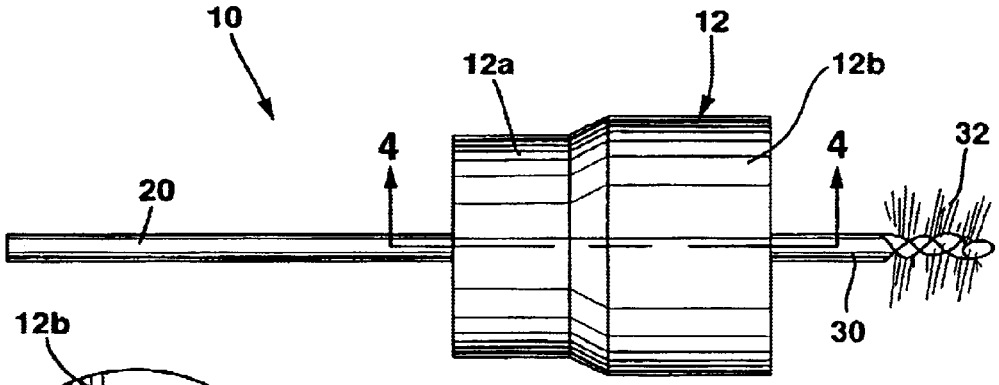
FIG. 1 is an elevational view of a copper pipe cleaning tool according to the present invention.
Figure 4:
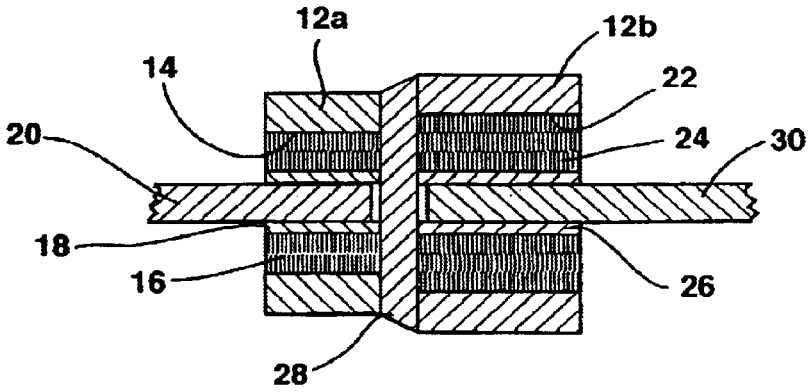
FIG. 4 is a cross-sectional view taken along line 4—4 in FIG. 1.

The present invention 10 is shown in FIG. 1. The invention 10 includes a holder body 12 having a first tubular portion 12*a* flaring into a larger diameter tubular portion. 12*b* as shown in FIG. 1. As shown in FIG. 4, a wall 28 is provided separating portion 12*a* from portion 12*b*.

Figure 2:
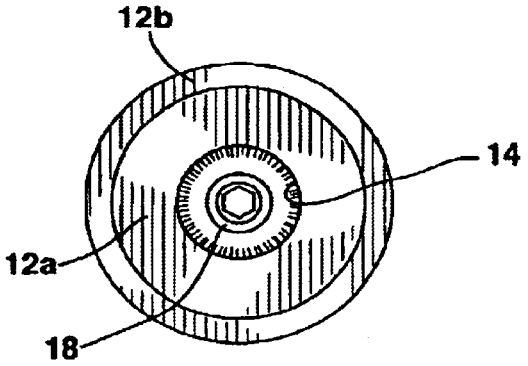
FIG. 2 is a left-side end view of the invention shown in FIG. 1 with a driving shank removed.

Tubular portion 12*a* includes an axial bore 14. A hard wire brush material 16 is affixed to the inner surface of portion 12*a* within bore 14 as shown in FIGS. 2 and 4. This brush material 16 extends in a radial direction toward a longitudinal axis of holder body 12. A tubular socket member 18 is axially affixed in bore 14 to wall 28, as shown in FIGS. 2 and 4. In a preferred embodiment, the tubular socket member 18 includes a polygonal-shaped opening which opens into axial bore 14. A driving shank 20 has one end to be received by a chuck of a power drill, for example, and has the other end shaped to have a polygonal exterior shape to be removably received by the socket 18, as shown in FIGS. 1 and 4.

Figure 3:
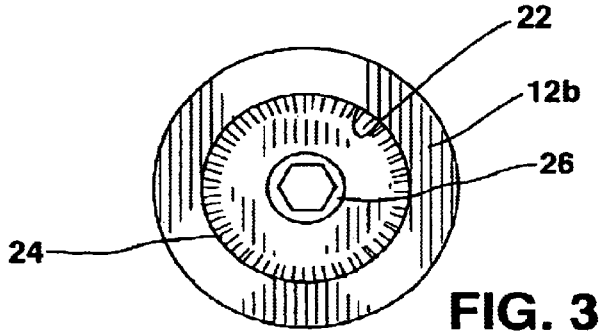
FIG. 3 is a right-side end view of the invention shown in FIG. 1 with a pipe cleaning brush removed.

The tubular portion 12*b* is provided with an axial bore 22, as shown in FIG. 3. A hard wire brush material is affixed to the inner surface of portion 12*b* within bore 22, as shown in FIGS. 3 and 4. This brush material extends in a radial direction toward a longitudinal axis of holder body 12. A tubular socket 26 is axially affixed in bore 22 to wall 28, as shown in FIGS. 3 and 4. The tubular socket 26 includes a polygonal-shaped opening which opens into axial bore 22.

A brush shank 30 has one end shaped to have a polygonal exterior shape sized to be removably received by the socket 26, as shown in FIGS. 1 and 4. A hard wire brush 32 is affixed to the other end of shank 30, as shown in FIG. 1. The brush 32 extends in a radial direction outwardly away from brush shank 30.

The tubular sockets 18 and 26 are shaped and sized identically. In using this invention, one end of drive shank 20 is inserted in socket 18. The other end is inserted in the chuck of a power drill for rotating the tool 10. The shank 30 is inserted in socket 26, as shown in FIGS. 1 and 3. A pipe to be cleaned in preparation for soldering is inserted in the bore 22 and the power drill turned on. Brush 24 will clean the outer surface of the pipe end inserted in bore 22, and wire brush 32 will simultaneously clean the inner surface of the pipe end. It should also be understood that when a pipe of a smaller diameter is to be cleaned, the shank 20 is inserted in the socket 26, as shown in FIG. 3, and the shank 30 is inserted in socket 18. Shanks 20 and 30 are interchangeable with sockets 18 and 26.

With the present invention, it is easy to clean the exterior and interior surfaces of an end of a copper pipe in preparation for soldering. It should also be understood that the present invention could also be used as a hand tool. With this configuration, driving shank 20 is not used and holder body 12 is turned manually.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. A tool for cleaning the outside and inside surfaces of a pipe in preparation for soldering comprising:

a holder body having a longitudinal axis and having a first tubular portion with a first diameter, the first tubular portion flaring into a second tubular portion having a diameter larger than the first diameter;

a transverse wall separating the first tubular portion from the second tubular portion;

the first tubular portion having an axial bore;

a hard wire brush affixed to the inner surface of the first tubular portion within the axial bore and extending in a radial direction toward the longitudinal axis;

a first tubular socket affixed on the longitudinal axis in the first tubular bore to the wall separating the first tubular portion from the second tubular portion;

the first tubular socket having a polygonal-shaped opening which opens into the first tubular bore;

the second tubular bore having an axial bore;

a hard wire brush affixed to the inner surface of the second tubular portion within the axial bore and extending in a radial diameter toward the longitudinal axis;

a second tubular socket affixed on the longitudinal axis in the second tubular bore to the wall separating the first tubular portion with the second tubular portion;

the second tubular socket having a polygonal-shaped opening which opens into the second tubular bore;

the first and second tubular sockets sized and shaped to be identical;

a drive shank having an end for use in a chuck or collar of a drill or other motor drive and a free end;

the free end of the drive shank having polygonal exterior shape sized to be removably received by the first or second tubular sockets;

a brush shank having a free end and a hard wire brush attached at the other end of the brush shank;

the brush extending in a radial direction away from the brush shank; and the free end of the brush shank having a polygonal exterior shape sized to be removably received by either the first or second tubular sockets.

2. A tool for cleaning the outside and inside surfaces of a pipe in preparation for soldering comprising:

a holder body having a longitudinal axis and having a first tubular portion with a first diameter, the first tubular portion flaring into a second tubular portion having a diameter larger than the first diameter;

a transverse wall separating the first tubular portion from the second tubular portion;

the first tubular portion having an axial bore;

a hard wire brush affixed to the inner surface of the first tubular portion within the axial bore and extending in a radial direction toward the longitudinal axis;

a first tubular socket affixed on the longitudinal axis in the first tubular bore to the wall separating the fist tubular portion from the second tubular portion;

the first tubular socket having a polygonal-shaped opening which opens into the first tubular bore;

the second tubular portion having an axial bore;

a hard wire brush affixed to the inner surface of the second tubular portion within the axial bore and extending in a radial direction toward the longitudinal axis;

a second tubular socket affixed on the longitudinal axis in the second tubular bore to the wall separating the first tubular portion with the second tubular portion;

the second tubular socket having a polygonal-shaped opening which opens into the second tubular bore;

the first and second tubular sockets sized and shaped to be identical;

a brush shank having a free end and a hard wire brush attached to the other end of the brush shank;

the brush extending in a radial direction away from the brush shank; and the free end of the brush shank having a polygonal exterior shape sized to be removably received by either the first or second tubular sockets.

* * * * *